United States Patent [19]

Ryder et al.

[11] Patent Number: 4,807,313

[45] Date of Patent: Feb. 28, 1989

[54] INFLATABLE INCLINED MATTRESS SUPPORT SYSTEM

[75] Inventors: Francis E. Ryder, Arab; Rowland W. Kanner, Guntersville, both of Ala.

[73] Assignee: Ryder International Corporation, Arab, Ala.

[21] Appl. No.: 73,353

[22] Filed: Jul. 10, 1987

Related U.S. Application Data

[63] Continuation-in-part of Ser. No. 804,262, Dec. 3, 1985, abandoned.

[51] Int. Cl.[4] ..... A61G 7/00; A47C 21/00

[52] U.S. Cl. ..... 5/62; 5/446; 5/508; 5/453

[58] Field of Search ..... 5/62, 446–450, 5/453–455, 457, 509, 411

[56] References Cited

U.S. PATENT DOCUMENTS

| | | | |
|---|---|---|---|
| 184,487 | 11/1876 | White . | |
| 211,741 | 1/1879 | Johnson | 5/448 |
| 388,037 | 8/1888 | Hargin . | |
| 595,734 | 12/1897 | Rand et al. . | |
| 1,156,523 | 10/1915 | Clemens | 5/457 |
| 1,382,531 | 6/1921 | Newborn | 5/441 |
| 1,432,875 | 10/1922 | Lavagetto | 5/449 |
| 1,981,666 | 11/1934 | Ridley | 5/453 |
| 2,241,466 | 5/1941 | Lovick | 5/411 |
| 2,245,900 | 6/1941 | Enfiajian . | |
| 2,724,133 | 11/1955 | Sorrell | 5/446 |
| 3,112,956 | 12/1963 | Schick et al. | 5/457 |
| 3,426,373 | 2/1969 | Scott et al. . | |
| 3,503,084 | 3/1970 | Meinwieser | 5/457 |
| 3,583,008 | 6/1971 | Edwards . | |
| 3,959,835 | 6/1976 | Nos | 5/455 |
| 4,142,263 | 3/1979 | Pierson | 5/453 |
| 4,309,783 | 1/1982 | Cammack et al. | 5/508 |
| 4,525,885 | 7/1985 | Hunt et al. | 5/453 |
| 4,542,547 | 9/1985 | Sato | 5/453 |

*Primary Examiner*—Alexander Grosz
*Assistant Examiner*—Michael F. Trettel
*Attorney, Agent, or Firm*—Trexler, Bushnell, Giangiorgi & Blackstone, Ltd.

[57] ABSTRACT

There is disclosed a system for selectively supporting a mattress at a predetermined angle of inclination with respect to a support surface, such as a box spring, or the like. The system comprises primarily an inflatable mattress support member which is connected to a selectively operable pneumatic pump via a combination check valve and release valve. In practice, the user or patient can inflate the mattress support member to provide the desired degree of inclination and when not in use the support member can be easily deflated to dispose the mattress in a relatively normal position. The mattress support member is provided by a plurality of adjacent interconnected inflatable cells, with the adjacent cells sharing a common wall portion having port means formed therein to pneumatically interconnect the respective cells. The cells are of declining size, starting at a first end of the inflatable mattress support member and progressing toward the opposite, second end thereof, and preferably ten or more cells are provided. The construction of the mattress support member is provided by a pair of sheet members which are bonded together about the periphery thereof, and are further bonded together at selected areas intermediate the ends thereof, which selected areas of bonding are spaced apart by varying distances and extend generally across the width of the mattress support member, except for those locations wherein the bonding is interrupted to provide openings or ports between the respective cells.

14 Claims, 2 Drawing Sheets

FIG. 5
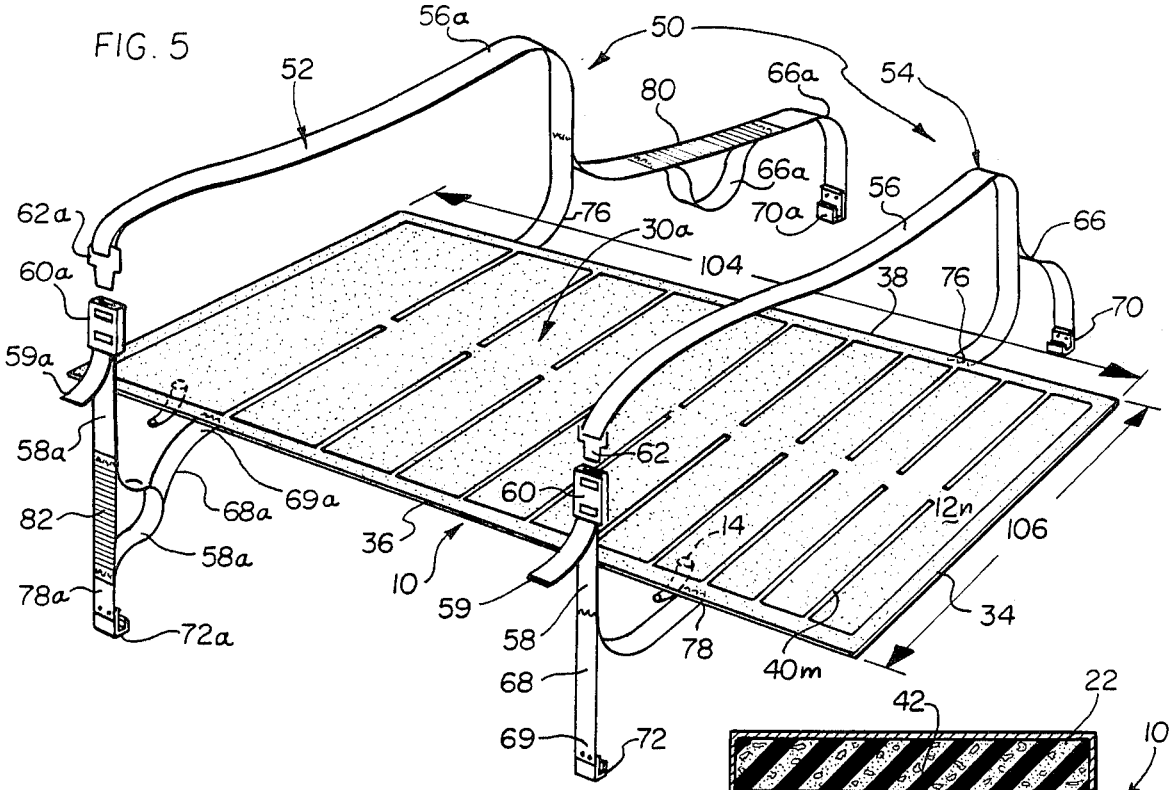
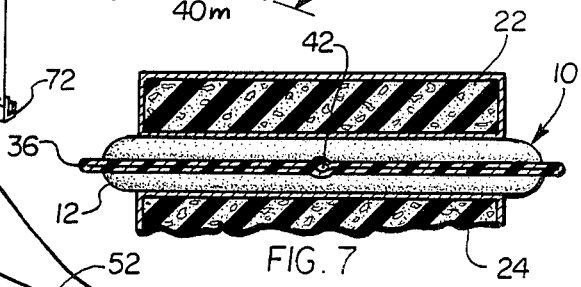
FIG. 7
FIG. 6
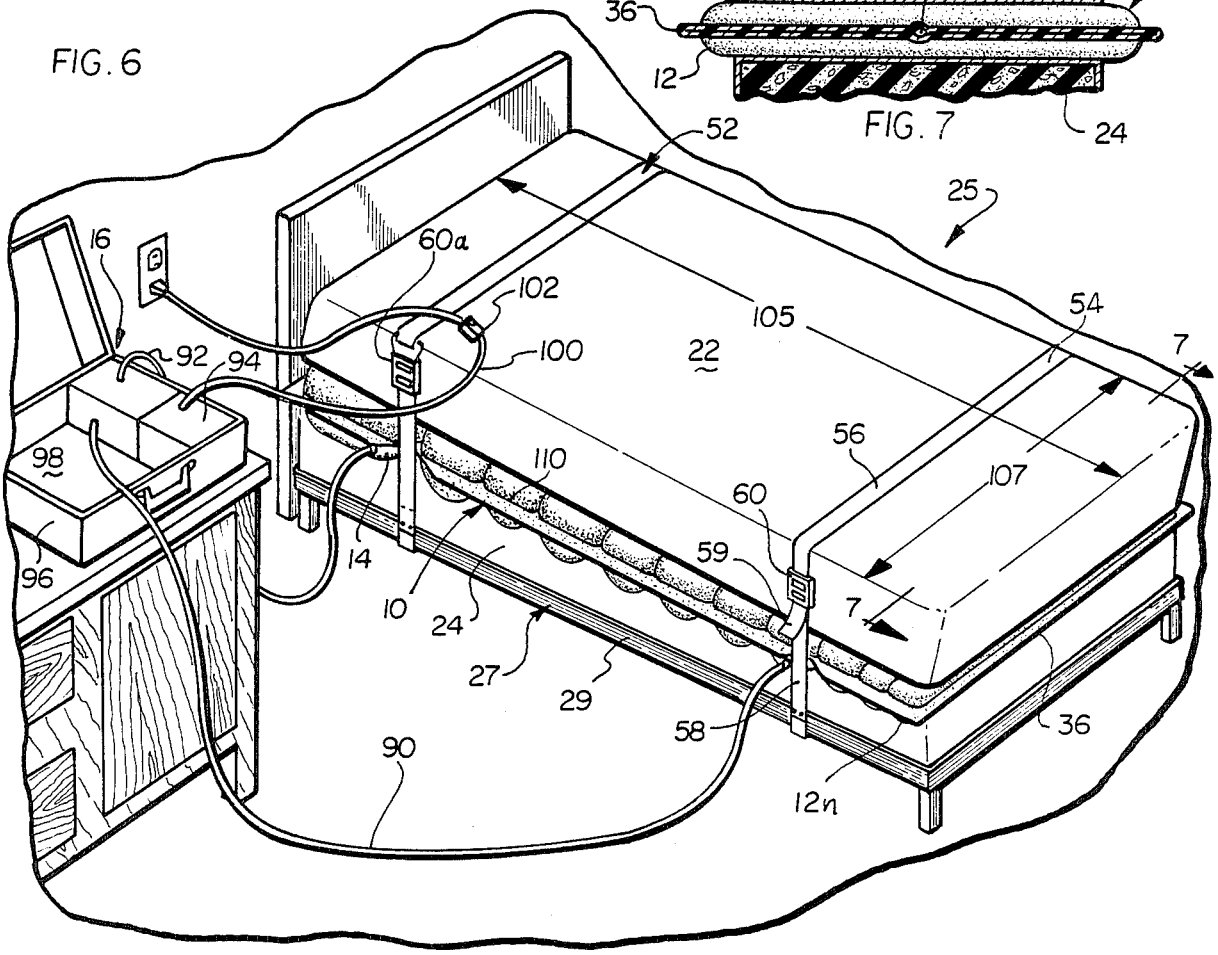

INFLATABLE INCLINED MATTRESS SUPPORT SYSTEM

This application in a continuation-in-part of application Ser. No. 804,262 filed Dec. 3, 1985, now abandoned.

BACKGROUND OF THE INVENTION

The present invention relates to the home health care field, and more particularly to an inflatable mattress support system for positioning a mattress at a predetermined degree of inclination.

With the esclation of hospital costs more emphasis is being placed upon home health care in order to reduce the overall expense to the patient and the insurance company for any instance of illness and/or hospitalization. In this regard, there are a number of disorders which can be treated readily at home, wherein the patient's discomfort is relieved or alleviated by having the patient supported in an inclined position, primarily during the sleeping hours. One of these is a common disorder referred to as a hiatal hernia. The esophagus enters the abdomen through an opening in the diaphragm which divides the abdomen from the thorax or chest cavity, and is connected to the upper part of the stomach. Normally, the diaphragm encircles the esophagus tightly thus maintaining the stomach entirely within the abdomen. In the case of a hiatal hernia, the opening in the diaphragm is somewhat enlarged so that the upper portion of the stomach projects into the thorax cavity. When this condition occurs, the gastric juice produced by the stomach tends to be loculated in the portion of the stomach above the diaphragm, and in the lower esophagus. When the patient is disposed in an inclined position, these gastric juices can move upwardly along the esophagus causing considerable discomfort, as well as ulceration and bleeding of the lower regions of the esophagus, a condition termed "esophagitis". One of the methods of alleviating the discomfort created by a hiatal hernia, is to have the patient sleep in an inclined position, that is a position with the patient's head about eight inches above his feet. The inclination of the patient during sleeping prevents the gastric juice from migrating into the lower region of the esophagus and is extremely effective in alleviating the discomfort occasioned due to a hiatal hernia.

While there are available on the market hospital-type beds for home use, these beds are expensive and are somewhat unsightly and do not fit into the normal bedroom decor or decorating scheme. Accordingly, the present invention provides a system whereby a hiatal hernia patient may selectively inflate a mattress support member to incline the mattress at a desired degree of inclination for sleeping, and thereafter deflate the mattress support member so that the mattress can assume a normal position at the time that the bed is to be made or otherwise covered with a bedspread or the like. The system is relatively inexpensive when compared with hospital-type beds and yet provides a desired degree of inclination in a convenient manner.

SUMMARY OF THE INVENTION

Accordingly, the present invention provides an improved mattress support system which can be easily and conveniently adjusted to provide the desired degree of inclination for sleeping, and can thereafter be deactivated or deflated so that a mattress can assume the normal position. More specifically, there is provided a selectively operable pneumatic pump and an inflatable mattress support member interconnected through a combination check and relief valve. The mattress support member of the illustrated embodiment of the present invention is comprised of a plurality of adjacent, connected inflatable cells with the adjacent cells sharing a common wall portion, with port means formed in said common wall portion to thereby pneumatically interconnect the adjacent cells. Air inlet means is associated with at least one cell so that the pump may be connected to the mattress support member to provide inflation as necessary. The respective cells are of a predetermined number and size such that the cell adjacent a first end of the mattress support member to be associated with the head of the mattress is the largest, with the size of each adjacent cell decreasing toward the opposite end of the mattress support member. Thus, when the mattress support member is inflated and disposed between a mattress and a box spring or some other supporting surface, the mattress will be disposed at a degree of inclination which will provide the patient with the desired relief from the effects of a hiatal hernia during slieeping.

BRIEF DESCRIPTION OF THE DRAWINGS

The illustrated embodiment of the present invention will now be described in greater detail with reference to the accompanying drawings. In this regard, the enclosed drawings illustrate a preferred form of the invention and are not to be considered as limiting with respect thereto.

FIG. 5 is a perspective view of the mattress support member of the invention, further provided with a strap means or assembly for securing the same to a bed and bed frame in accordance with a preferred form of the invention; and FIG. 6 is a perspective view of a bed having a mattress support assembly in accordance with the embodiment of FIG. 5 secured thereto; and FIG. 7 is a sectional view taken generally along the line 7—7 of FIG. 6.

DETAILED DESCRIPTION OF THE ILLUSTRATED EMBODIMENT

Figure 1:
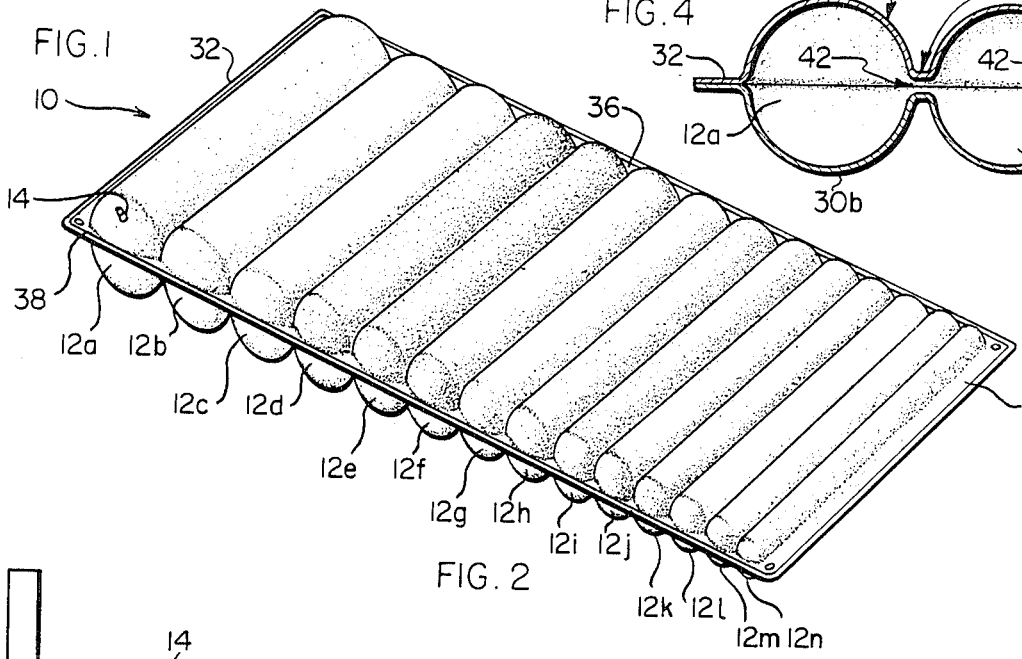
FIG. 1 is a perspective view of a mattress support member in accordance with the present invention.

Referring now to the drawings, FIG. 1 illustrates in perspective, the inflatable mattress support member which is a primary component of the overall system of the present invention. In this regard, the inflatable mattress support member is designated generally 10 and is of an elongate, polygonal shape. The inflatable support member 10 is comprised of a number of individual cells or bladders, designated 12*a*–12*n*, with the cell 12*a* adjacent a first edge of the mattress support member 10 being of a larger configuration or height than the remaining cells, with the cells 12*b* through 12*n* decreasing in size toward the opposite end of the mattress support member 10. In addition, the inflatable mattress support member 10 includes one or more pneumatic inlet fittings 14, only one of which is disclosed with respect to the illustrated embodiment in conjunction with the cell 12*a*. As will be discussed in greater detail hereinafter, each of the individual cells 12*a*–12*n* of the support member 10 are pneumatically interconnected. Accordingly, air introduced into the cell 12*a* through the fitting 14 will inflate the entire mattress support member 10.

It should be noted that in the illustrated embodiment a single inlet fitting 14 is provided, and each of the plurality of cells 12*a*–12*n* are interconnected through openings in the adjacent, common cell walls thereof. It is envisioned, however, that a plurality of fittings could be employed. In this instance, it would not be necessary to interconnect all of the cells, as only the group or number of cells associated with each fitting need be pneumatically interconnected.

Figure 2:
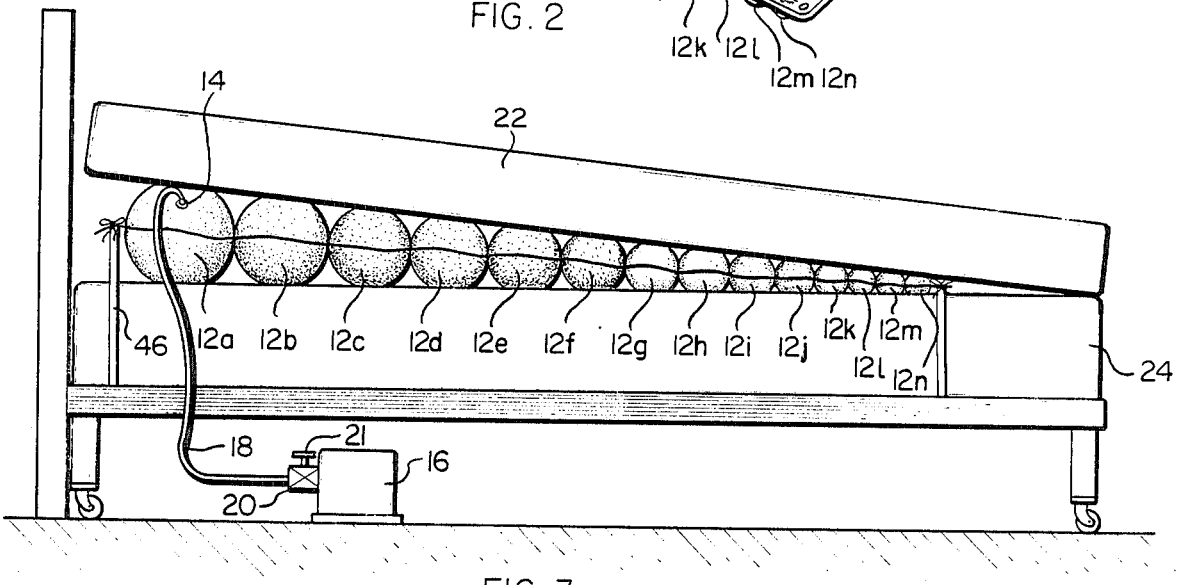
FIG. 2 is an elevational view of the inflatable inclined mattress support system employed in conjunction with a conventional bed to support a mattress at an inclined angle.

Attention is now invited to FIG. 2 which illustrates the manner in which the inflatable mattress support member 10 is used in conjunction with conventional bedding and also illustrated the remainder of the overall system of the invention. More specifically, the system includes a selectively operable pneumatic pump 16 which is connected to the support member fitting 14 by conventional tubing 18 and a combination check and relief valve 20. In use the pneumatic pump, which is preferably electrically operated can be turned on to attain the desired degree of inflation of the mattress. The pneumatic pump 20 is self-regulating and will cease operation once a predetermined pressure is attained within the support member 10. During filling of the support member 10, the relief valve feature 21 of the valve 20 is deactivated, so that the valve operates as a one-way check valve to permit inflation of the mattress, but prevents deflation thereof. As can be seen, upon inflation of the mattress support member 10 due to the decreasing size of the cells 12*a*–12*n*, and the disposition of the mattress support member 10 intermediate the mattress 22 and an underlying support surface, in this instance provided by the box spring 24, the mattress 22 will be disposed at an incline. In practice, the degree of inclination from the head of the mattress to the foot thereof is approximately eight inches. Further, due to the overall construction of the mattress support member 10, the mattress 22 is supported uniformly across its entire width.

At the end of a nights sleep, the hiatal hernia patient need only operate the relief valve 21 of the combination valve 20 to deflate the mattress support member 10, permitting the mattress 22 to assume a relativley normal position parallel to the box spring 24. The bed can then be made in a conventional manner, with the presence of the inclined support system being relatively unobtrusive. As such, the bed will have a normal or conventional appearance and the components of the system are concealed so that they do not conflict with the overall decor or esthetics of the bedroom.

Figure 4:
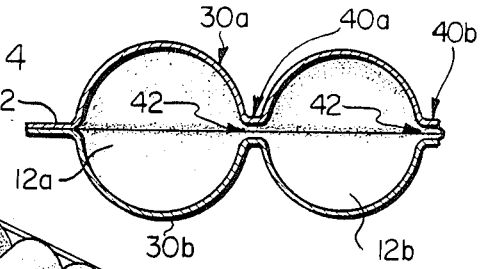
FIG. 4 is a partial sectional view taken through two adjacent cells along the longitudinal center line of the mattress support member
Figure 3:
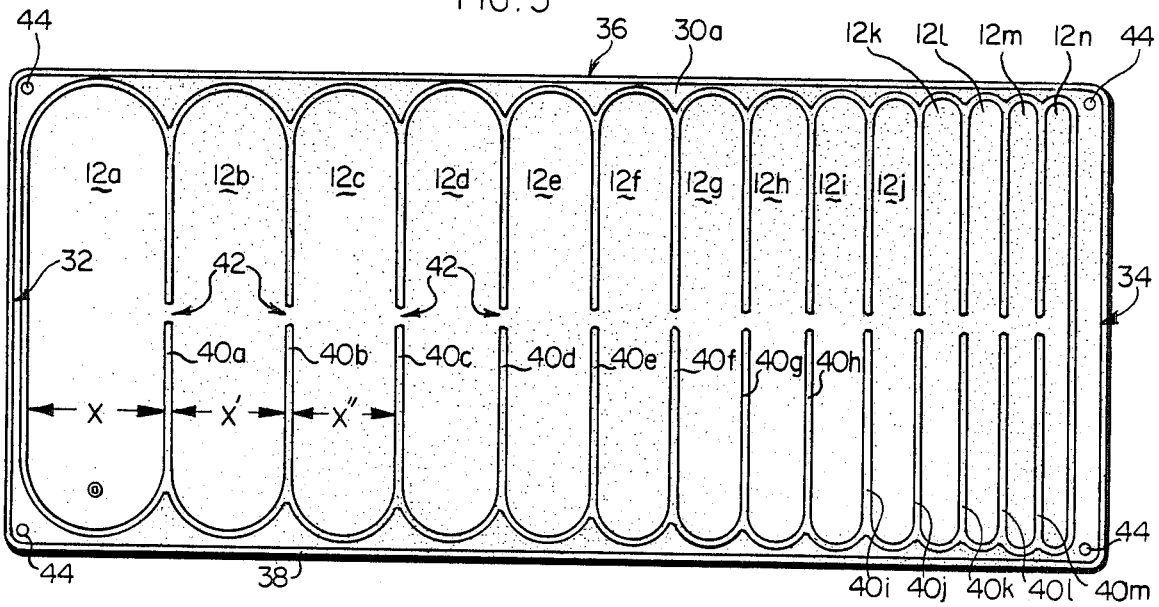
FIG. 3 is a top plan view of a deflated mattress support member indicating the areas of bonding of the respective layers thereof.

Attention is invited to FIGS. 3 and 4 which illustrate the manner of construction or fabrication of the inflatable mattress support member 10 of the illustrated embodiment of the invention. More specifically, FIG. 3 is a plan view of a deflated support member 10, illustrating the areas or locations of bonding between the respective upper and lower layers thereof which serve to define the cells 12*a*–12*n*, as will be discussed with respect to FIG. 4. FIG. 4, on the other hand, is a partial sectional view through adjacent cells 12*a* and 12*b*, illustrating the manner in which upper and lower sections of sheet material are bonded together to provide said adjacent cells.

More specifically, with reference to FIG. 4, the inflatable mattress support member 10 is comprised of an upper section of sheet material 30*a* which is bonded to a lower section of sheet material 30*b* at selected locations, which are best illustrated in FIG. 3. The sheets 30*a* and 30*b* are preferably fabricated from a thermoplastic material such as plasticized polyvinylchloride. The bonding of the upper and lower sheets 30*a* and 30*b* preferably is effected with a thermal process wherein the upper and lower sections of sheet material 30*a* 30*b* are fused together in the appropriate areas, as indicated in FIG. 3. It should be noted, however, that bonding can be affected by various alternate meas such as ultrasonic welding of the sheets 30*a* and 30*b*, or by use of an adhesive.

With refernce to FIG. 3, it can be seen that the respective sheets 30*a* and 30*b* are bonded together about the entire periphery thereof, as well as at selected spaced locations intermediate the ends of the sheets. The areas of bonding are indicated by the double lines, and those about the periphery of the sheets 30*a* and 30*b* serve to define opposed end wall portion 32 and 34 as well as spaced side walls 36 and 38 for the support member 10. In addition, the upper and lower sheets 30*a* and 30*b* are bonded together at a series of intermediate locations also indicated by double lines and designated 40*a*–40*m*, which locations are spaced apart along the length of the inflatable support member 10 by ever decreasing distances X, X′, X″, etc. The spacing between the respective areas of bonding extending transversely across the length of the support member 10 serve to define the final size of the cells 12*a*–12*n* when the member 10 is inflated. As a further matter, it should be noted that the areas of bonding 40*a*–40*m* are interrupted at selected locations, which serve to provide ports or apertures 42 between the adjacent individual cells 12*a* and 12*n* which ports are open and serve to pneumatically interconnect said cells, as discussed previously. More specifically, with regard to FIG. 4, it can be seen that where the bonding is interrupted, the sheets 30*a* and 30*b* merely overlie each other and in effect operate to define a port or passage 42 between the adjacent cells.

In addition, it should be noted that at the respective corners of the polygonal shaped mattress support member 10, there is provided a series of openings designated generally 44. These openings can be used with hold down means 46, FIG. 3, to fix the position of the support member in place relative to the box spring 24, or alternately the ties could be brought around the mattress 22, if desired.

In summary, there is disclosed an overall system comprised of the selectively operable pneumatic pump 16, combination valve means 20 and an inflatable mattress support member 10 which can be employed to dispose a mattress 22 at a degree of inclination which will provide a patient with the necessary relief from the effects of a hiatal hernia, or some other disorder. Further, rather than using the support member 10 to raise the head of the mattress 22, the position of the support member 10 could be reversed from that as shown to raise the foot portion of the mattress, if desired. The disclosed embodiment of the inflatable mattress support member 10 is comprised of a plurality of adjacent interconnected inflatable cells 12a–12n which cells share common wall portions 40a–40m, said wall portions are apertures to define openings 42 which serve to pneumatically interconnect the adjacent cells. Further, the cells 12a–12n are of decreasing size, with the largest cell being disposed adjacent the end wall portion 32, the size of the cells decreasing toward the opposite end wall portion 34.

While a preferred form of the present invention has been illustrated, wherein the mattress support member 10 is comprised of a pair of sheet members 30a and 30b which have been bonded together to define the various inflatable cells, it is envisioned, that an arrangement could be employed wherein the cells are individual bladders of varying size, which are positioned within an enclosure adapted to accommodate each individual cell. In this modification, the individual bladders would not share a common wall and would be interconnected for inflation and deflation by a manifold arrangement.

Thus, there is provided a relatively simple and inexpensive arrangement whereby a patient can obtain the benefits of inclined disposition during sleeping, without incurring the cost of inconvenience of a hospital-style bed.

Referring now to FIGS. 5 and 6, in accordance with a preferred form of the invention, the inflatable mattress support member is further provided with integrally connected strap means 50 for securing the same to the bed and bed frame as indicated generally in FIG. 6. In the embodiment of FIGS. 5 and 6, like reference numerals have been utilized throughout to indicate like parts and components with respect to the inflatable support member and the bed and bed frame to which it is secured. In this regard, the bed structure is indicated in FIG. 6 generally by reference numeral 25, and it includes the previously mentioned mattress 22 and support surface or box spring member 24, and also a bed frame 27 having opposing side rail portions, only one of which appears in FIG. 6 and is designated by reference numeral 29.

Turning initially to FIG. 6, the generally rectangular, elongate mattress support member 10, configured in accordance with a preferred form of the invention, is further provided with novel strap means 50 for, in use, securing the member 10 to the bed frame 27 and mattress 22, between the mattress 22 and support member or box spring 24. The strap means 50 comprises first and second strap assemblies 52, 54, which are coupled with the inflatable mattress support member 10 at longitudinally spaced locations thereon. The locations at which strap assemblies 52 and 54 are secured are generally such as to secure the same adjacent respective head and foot portions of the bed 25, as shown in FIG. 6.

Each of the strap assemblies is constructed of a plurality of like parts, whereby the strap assembly 54 will be initially described in detail, it being understood that like parts and components are utilized to form strap assembly 52 as well, and are indicated by like reference numerals with suffix a.

Strap assembly 54 comprises first and second elongate strap or belt-like members or portions 56, 58, which carry at respective first ends thereof a pair of complimentary mating buckle members or buckle halves 60, 62. These buckle members or halves are selectively engageable and disengageable for releasably buckling the associated ends of strap members 56, 58 together to secure the same generally around the mattress 22, as shown for example in FIG. 6.

One of the buckle members, and as herein illustrated, the buckle member 60, further is arranged for receiving an end of strap 58 therethrough in an adjustable manner, that is, for adjusting the effective length of the strap member 58. This is indicated in the drawings by a protruding end portion 59 of strap member 58. This adjustable arrangement may be effected in any of plurality of known manners relative to the buckle half or portion 60, and need not be described in detail herein.

Each of strap members 56, 58 has coupled therewith one end of a further or intermediate elongate strap or belt-like member or portions 66, 68. In the illustrated embodiment these strap portions 66, 68 have respective frame-engaging means or member, preferably in the form of rigid hook-like members 70, 72, secured to opposite free ends thereof. Accordingly, the second or opposite ends of the first and second strap members 56 and 58 are coupled or secured with opposite edges or margins of the inflatable mattress support member 10 as indicated generally at 76, 78. This securing may be by means of sewing, adhesives, heat or pressure securing of the same intermediate the sheets 32a, 32b, or by any other suitable means, without departing from the invention.

Importantly, it should be noted that the above-described arrangement may be varied if desired without departing from the invention. That is, the hook-like engagement members 70, 72 may alternatively be provided at the respective ends 76, 78 of the straps 56, 58, with the intermediate straps 66, 68 having their opposite ends secured to the inflatable mattress support member 10. In this regard, this alternative arrangement is illustrated with respect to the strap member 58a. That is, end 69a of intermediate strap 68a has been secured to the edge of support member 10, while end 78a of strap 58a has been affixed to hook-like engagement member 72a.

In addition to the structure thus far described, strap assembly 52 additionally incorporates at least one, and preferably two, elastic band members 80, 82. These elastic band members 80, 82 are generally secured to respective strap portions 58a and 66a, in the illustrated embodiment, spanning predetermined portions of straps 58a, 66a spanned by elastic bands or belts 80, 82 are substantially greater in length than the respective elastic bands when the latter are in their relaxed condition, as illustrated in FIG. 5. Hence, when the bands are relaxed as illustrated in FIG. 5, the respective belts or belt portions 58a and 66a define substantial additional loops spanned by the elastic bands. In use, this permits additional effective expansion or lengthening of the belt portions 58a, 66a to accommodate inflation of the upper or head portion of the inflatable mattress member 10, as indicated in FIG. 6.

Referring now more particularly to FIG. 6, an electrically powered pump 16, which may incorporate the necessary check and relief valves 20, which are not separately illustrated in FIG. 6, may be coupled via suitable tubing 90, 92 to respective fittings 14 of the support member 10. Preferably, the pump 6 is driven by a relatively small, compact electric motor, contained within an adjacent housing 94, both pump and motor units 92, 94 being in turn carried within a convenient carrying case 96. Moreover, the carrying case 96 includes an additional free area or volume 98 therein for accommodating the inflatable mattress support member 10 including the strap means 50, when the same is in a deflated condition and suitably folded. Hence, the entire illustrated system including inflatable support 10, strap means 50, pump 16 and motor, together with suitable connecting tubing may be provided as a protable unit, transportable within the carrying case 96. A suitable electric cord 100 with a patient accessible switch 102 may also be provided integral with the unit or carrying case 96, and preferably extending from motor housing 94.

In use, as best viewed in FIG. 6, the inflatable mattress support assembly may be relatively readily and simply assembled with the bed 25 by initially removing the inflatable member 10 and straps from carrying case 96 and unfolding or unrolling the same into a flat condition on the floor or other surface, as generally illustrated in FIG. 5. Initially, the first strap portions 56, 56*a* which are preferably relatively longer than strap portions 58, 58*a* may be utilized to pull or slide the inflatable support member 10 into position between the mattress and box spring. Thereupon, all four of the frame-engaging hooks 70, 72 and 70*a*, 72*a* may be engaged with respective adjacent portions of the side rail 29 of frame 27. Thereupon the straps 56, 56*a* may be wrapped around and over the mattress 22 and the respective buckle portion 60, 62 and 60*a*, 62*a* interengaged and secured. The strap 54 may next be tightened or secured tightly about the mattress 24 by grasping free end 59 and pulling through buckle half or portions 60. The upper or head end strap 52 will be similarly pulled taut, but only until the elastic bands 80, 82 are sufficiently taut to just hold the hooks 70*a*, 72*a* in place, that is, without appreciably stretching the elastic bands. Hence, the elastic bands allow for the necessary inflation of the upper or head end of the inflatable support member 10.

Upon thus far securing the assembly with the bed, the air pump unit may be plugged in and activated to fully inflate the inflatable support member 10. Thereupon, the upper strap assembly 52 may be further tightened if desired by further pulling upon protruding strap end 59*a* relative to buckle portion 60*a*.

In accordance with a preferred form of the invention, and as indicated in FIGS. 5 and 6, it should be noted that the inflatable mattress support member in its deflated condition is both longer and wider than the mattress 22 of the bed with which it is to be used. That is, the length 104 of the deflated support member 10 is considerably greater than the length 105 of mattress 22. Advantageously, this length 104 and the points of attachment of the respective strap means or assemblies 50, 52 longitudinally thereof is such that the strap assemblies 50 and 52 will be initially located to the outside of respective top and bottom ends of mattress 22. Accordingly, the user need only position the straps to either end of the mattress 22 and utilizing the straps pull or draw the deflated support member 10 between mattress 22 and its support member or box spring 24. Advantageously, the mattress 22 need not be physically lifted from its support or box spring 24, therefore, to accomplish the disposition of inflatable support member 10 therebetween.

This is particularly advantageous in the case of highatal hernia patients, for whom strains associated with lifting objects are to be avoided. Hence, such a patient could readily employ the inflatable support member as illustrated in FIGS. 5 and 6, with its portable carrying case 96 including the necessary pump valves and tubing, while travelling.

In this regard, it should be appreciated that upon inflation of the support member 10, the length thereof will decrease significantly, and up to on the order of 16 percent, thus drawing the respective strap means or assemblies 50, 52 well within the top and bottom ends of the mattress 22, as illustrated in FIG. 6. In this regard, it will be appreciated, for example, that the length of each of the segments or inflatable cells 12*a* . . . 12*n* is substantially one-half of its circumference when deflated. However, upon inflation, the effective length of each cell is substantially on the order of its diameter, which will be appreciated to be the circumference divided by the factor pi (3.14158 . . . ). Hence, the ratio between deflated and inflated effective widths of the respective cells is on the order of 16 percent of the circumference thereof, which indicates a change in overall length of on the order of 16 percent.

Advantageously the overall width 106 of the support member 10 remains somewhat greater than the overall width 107 of mattress 22, even when the support member 10 is in its inflated state as illustrated in FIG. 6. Hence, substantial end portions 110 of the respective cells 12*a* . . . 12*n* protrude outwardly to either side of mattress 22. This arrangement advantageously greatly decreases the possibility of tilting or sagging of the mattress 22 to one side or the other relative to the inflatable support member 10, as might occur if the support member 10 were only the same width as, or some lesser width than the mattress 22.

While a preferred embodiment of the present invention has been illustrated and described, it is envisioned that those skilled in the art once appraised of the present disclosure and/or the invention illustrated therein, may very will devise various modifications without departing from the true spirit and scope of the invention as defined in the claims appended hereto.

The invention is claimed as follows:

1. An inflatable mattress support assembly, for use with a bed having a bed frame, a supporting surface and a mattress, for disposition between said supporting surface and said mattress for positioning the mattress at an inclined angle with respect to said supporting surface, said inflatable mattress support assembly comprising: an inflatable mattress support member comprising a plurality of inflatable cells, said cells being interconnected to provide an integral elongate support member; air inlet means associated with at least one of said inflatable cells, port means provided between certain of said cells to provide for inflation and deflation thereof; the inflatable cell adjacent a first end of said integral elongate support member having a predetermined size and the size of each adjacent cell decreasing in the direction of a second, opposite end of said elongate support member, such that when said elongate support member is inflated and disposed between said support surface and said mattress in use, said mattress will be positioned at an inclined angle with respect to said support surface; and strap means for, in use, securing said inflatable mattress support member to said bed frame and said mattress, said strap means comprising first and second strap assemblies coupled with said inflatable mattress support member at longitudinally spaced locations thereon so as to secure the same substantially adjacent respective head and foot portions of said bed frame; each of said strap assemblies comprising first and second elongate strap members, a pair of complementary mating buckle members respectively secured to first ends of said first and second strap members for releasably buckling said ends together, respective first and second elongate intermediate strap members having first ends respectively coupled to mid-portions of said first and second strap members, frame engaging members coupled with second ends of selected ones of said first and second strap members and of said first and second intermediate strap members opposite said first ends thereof for engagement, in use, with said bed frame, and second ends other than said selected ones of said second ends being coupled with opposing lateral edges of said inflatable mattress support member.

2. An assembly according to claim 1 and further including adjusting means on at least one of said complementary mating buckle members for adjusting the effective length of the strap member connected thereto.

3. An assembly according to claim 1 wherein said frame engaging members comprise rigid, hook-like members.

4. An assembly according to claim 1 wherein at least the one of said strap assemblies coupled most closely adjacent said first end of said integral elongate support member further comprises at least one elastic member spanning a predetermined portion of the length of one of said first and second elongate strap members thereof, said predetermined portion being of substantially greater length than the length of the spanning elastic member when the latter is in a relaxed condition, to thereby permit inflation of said inflatable mattress support member following the securing of the same to said bed with said strap means.

5. An assembly according to claim 1 wherein said integral elongate support member is substantially greater in length, in its deflated state, than the mattress to which it is to be secured in use, and wherein said strap members are secured to said inflatable mattress support member at positions thereon which are spaced apart longitudinally by a length at least as great as the length of the mattress with which the support member is to be secured in use when said member is in its deflated state.

6. An assembly according to claim 1 wherein said inflatable mattress support member is, when in its inflated condition, wider than the mattress to which it is to be secured in use, so as to substantially discourage tilting of the same from side to side relative to the inflatable support member when in use.

7. A system for selectively supporting a mattress at a predetermined angle of inclination with respect to a support surface, said system comprising: a selectively operable pneumatic pump, an inflatable mattress support member disposable between a support surface and the mattress, and valve means for controlling the inflation of said mattress support member, said inflatable mattress support member comprising a plurality of inflatable cells, means pneumatically interconnecting said cells, the cells being of declining size starting at a first end of the inflatable mattress support member and progressing towards the opposite, second end thereof whereby when inflated said mattress support member is adapted to position a mattress at an inclined angle with respect to its support surface, said valve means being operable to deflate said mattress support member so that the mattress can assume a normal, parallel position with respect to said support surface when the system is not in use; and strap means for, in use, securing said inflatable mattress support member to said bed frame and said mattress, said strap means comprising first and second strap assemblies coupled with said inflatable mattress support member at longitudinally spaced locations thereon so as to secure the same substantially adjacent respective head and foot portions of said bed frame; each of said strap assemblies comprising first and second elongate strap members, a pair of complementary mating buckle members respectively secured to first ends of said first and second strap members for releasably buckling said first together, respective first and second elongate intermediate strap members having first ends respectively coupled to mid-portions first of said first and second strap members, frame engaging members coupled with second ends of selected ones of said first and second strap members and first and second intermediate strap members opposite of said first ends thereof for engagement, in use, with said bed frame, and ends other than the selected ones of said second ends being coupled with opposing lateral edges of said inflatable mattress support member.

8. A system according to claim 7, wherein said valve means includes a check valve to prevent inadvertent deflation of said mattress support member, and a selectively operable valve means for deflating said mattress support member.

9. An inflatable mattress support assembly, for use with a bed having a bed frame, a supporting surface and a mattress, for disposition between said supporting surface and said mattress for positioning the mattress at an inclined angle with respect to said supporting surface, said inflatable mattress support assembly comprising: an inflatable mattress support member comprising a plurality of inflatable cells, said cells being interconnected to provide an integral elongate support member; air inlet means associated with at least one of said inflatable cells, port means provided between certain of said cells to provide for inflation and deflation thereof; the inflatable cell adjacent a first end of said integral elongate support member having a predetermined size and the size of each adjacent cell decreasing in the direction of a second, opposite end of said elongate support member, such that when said elongate support member is inflated and disposed between said support surface and said mattress in use, said mattress will be positioned at an inclined angle with respect to said support surface; and strap means for, in use, securing said inflatable mattress support member to said bed frame and said mattress; wherein said integral elongate support member is substantially greater in length, in its deflated state, than the mattress to which it is to be secured in use, and wherein said strap means comprise a pair of strap assemblies which are secured to opposite lateral sides of said inflatable mattress support member at positions thereon which are spaced apart longitudinally by a length at least as great as the length of the mattress to which the support member is to be secured in use when said member is in its deflated state.

10. An assembly according to claim 9 wherein said inflatable mattress support member is, when in its inflated condition, wider than the mattress to which it is to be secured in use, so as to substantially discourage tilting of the same from side to side relative to the inflatable support member when in use.

11. An inflatable mattress support assembly, for use with a bed having a bed frame, a supporting surface and a mattress, for disposition between said supporting surface and said mattress for positioning the mattress at an inclined angle with respect to said supporting surface, said inflatable mattress support assembly comprising: an inflatable mattress support member comprising a plurality of inflatable cells, said cells being interconnected to provide an integral elongate support member; air inlet means associated with at least one of said inflatable cells, port means provided between certain of said cells to provide for inflation and deflation thereof; the inflatable cell adjacent a first end of said integral elongate support member having a predetermined size and the size of each adjacent cell decreasing in the direction of a second, opposite end of said elongate support member, such that when said elongate support member is inflated and disposed between said support surface and said mattress in use, said mattress will be positioned at an inclined angle with respect to said support surface; and strap means connected to said support member for, in use, securing said inflatable mattress support member to said bed frame and said said mattress; wherein said inflatable mattress support member is, when in its inflated condition, wider than the mattress to which it is to be secured in use, so as to substantially discourage tilting of the same from side to side relative to the inflatable support member when in use.

12. In combination with a bed having a bed frame, a support surface and a mattress, an inflatable mattress support assembly for disposition between said supporting surface and said mattress for positioning the mattress at an inclined angle with respect to said support surface, said inflatable mattress support assembly comprising: an inflatable mattress support comprising a plurality of inflatable cells, said cells being interconnected to provide an integral elongate support member; air inlet means associated with at least one of said inflatable cells, port means provided between certain of said cells to provide for inflation and deflation thereof; the inflatable cell adjacent a first end of said integral elongate support member having a predetermined size and the size of each adjacent cell decreasing in the direction of a second, opposite end of said elongate support member, such that when said elongate support member is inflated and disposed between said support surface and said mattress in use, said mattress will be positioned at an inclined angle with respect to said support surface; and strap means for, in use, securing said inflatable mattress support member to said bed frame and said mattress; wherein said integral elongate support member is substantially greater in length, in its deflated state, than the mattress to which it is to be secured in use, and wherein said strap means comprise a pair of strap assemblies which are secured to opposite lateral sides of said inflatable mattress support member at positions thereon which are spaced apart longitudinally by a length at least as great as the length of the mattress to which the support member is to be secured in use when said member is in its deflated state.

13. The combination according to claim 13 wherein said inflatable mattress support member is, when in its inflated condition, wider than the mattress to which it is to be secured in use, so as to substantially discourage tilting of the same from side to side relative to the inflatable support member when in use.

14. In combination with a bed having a bed frame, a supporting surface and a mattress, an inflatable mattress support assembly for disposition between said supporting surface and said mattress for positioning at an inclined angle with respect to said support surface, said inflatable mattress support assembly comprising: an inflatable mattress support member comprising a plurality of inflatable cells, said cells being interconnected to provide an integral elongate support member; air inlet means associated with at least one of said inflatable cells, port means provided between certain of said cells to provide for inflation and deflation thereof; the inflatable cell adjacent a first end of said integral elongate support member having a predetermined size and the size of each adjacent cell decreasing in the direction of a second, opposite end of said elongate support member, such that when said elongate support member is inflated and disposed between said support surface and said mattress in use, said mattress will be positioned at an inclined angle with respect to said support surface; and strap means for, in use, securing said inflatable mattress support member to said bed frame and said mattress; wherein said inflatable mattress support member is, when in its inflated condition, wider than the mattress to which it is to be secured in use, so as to substantially discourage tilting of the same from side to side relative to the inflatable support member when in use.

* * * * *